US007581650B1

(12) United States Patent
Shen

(10) Patent No.: US 7,581,650 B1
(45) Date of Patent: Sep. 1, 2009

(54) KNOCKDOWN MAGAZINE AND BOOK RACK KIT

(76) Inventor: Ziming Shen, 225 Howard Ave., Staten Island, NY (US) 10301

( * ) Notice: Subject to any disclaimer, the term of this patent is extended or adjusted under 35 U.S.C. 154(b) by 0 days.

(21) Appl. No.: 12/074,638

(22) Filed: Mar. 4, 2008

(51) Int. Cl.
*A47F 7/14* (2006.01)

(52) U.S. Cl. ..... 211/55

(58) Field of Classification Search ..... 211/55, 211/189, 52, 134; 108/180, 193, 153.1, 92, 108/157.13, 101
See application file for complete search history.

(56) References Cited

U.S. PATENT DOCUMENTS

| | | | | | |
|---|---|---|---|---|---|
| 1,594,754 | A | * | 8/1926 | Reines | 108/61 |
| 1,700,212 | A | | 1/1929 | Arlt | |
| 2,067,051 | A | * | 1/1937 | Hall | 211/55 |
| 2,192,243 | A | * | 3/1940 | Rogers | 211/55 |
| 2,251,814 | A | | 8/1941 | Yohns | |
| 2,462,321 | A | | 2/1949 | Holmes | |
| 2,642,326 | A | | 6/1953 | Taylor | |
| 2,769,551 | A | | 11/1956 | Just | |
| 2,784,847 | A | * | 3/1957 | Holroyd | 211/55 |
| 3,145,851 | A | | 8/1964 | Magers | |
| 3,149,727 | A | | 9/1964 | Magers | |
| 3,362,610 | A | | 1/1968 | Van Dyke | |
| 3,394,973 | A | * | 7/1968 | Scott | 312/262 |
| 3,519,320 | A | * | 7/1970 | Freedman | 312/258 |
| 3,549,019 | A | | 12/1970 | Wood et al. | |
| 3,549,020 | A | | 12/1970 | Von Bohr | |
| 3,777,997 | A | * | 12/1973 | Spiroch et al. | 242/597.8 |
| 3,892,450 | A | * | 7/1975 | Kolster et al. | 312/117 |
| 6,170,674 | B1 | * | 1/2001 | Caterinacci | 211/41.1 |
| 6,170,677 | B1 | * | 1/2001 | Meltser | 211/55 |
| 6,427,853 | B2 | * | 8/2002 | Brozak, Jr. | 211/55 |
| 6,955,268 | B2 | * | 10/2005 | Waldron | 211/51 |
| 7,083,053 | B2 | * | 8/2006 | Campbell | 211/55 |
| 7,097,049 | B1 | * | 8/2006 | Singer et al. | 211/55 |
| 2001/0025823 | A1 | * | 10/2001 | Brozak | 211/55 |
| 2007/0170126 | A1 | * | 7/2007 | Singer et al. | 211/55 |
| 2008/0078728 | A1 | * | 4/2008 | Hodge | 211/55 |

* cited by examiner

*Primary Examiner*—Jennifer E. Novosad
(74) *Attorney, Agent, or Firm*—Alfred M. Walker; Harvey Lunenfeld

(57) ABSTRACT

A knockdown magazine and book rack kit, comprising: a pair of prefabricated wooden magazine and book racks constructed of a plurality of substantially J shaped channels for holding books and magazines therein, a pair of wooden substantially symmetrical hexagonal shaped opposing side panels substantially perpendicularly removably fastened to the pair of prefabricated wooden magazine and book racks one to the other, a laterally directed substantially E shaped channel member receiving uppermost portions of the pair of prefabricated wooden magazine and book racks therein, the laterally directed substantially E shaped channel member having opposing ends removably fastened to the wooden substantially symmetrical hexagonal shaped opposing side panels and holding the uppermost portions of the pair of prefabricated wooden magazine and book racks in place, and comprising nesting and interleaving the pair of prefabricated wooden magazine and book racks within a shipping container to shipping volume and size and decrease shipping costs.

6 Claims, 19 Drawing Sheets

KNOCKDOWN MAGAZINE AND BOOK RACK KIT

BACKGROUND OF THE INVENTION

1. Field of the Invention

The present invention relates generally to magazine and book racks and more particularly to knockdown magazine and book rack kits.

2. Background Art

Free standing magazine and book racks having shelves for supporting magazines and books on one or two sides have been known. These free standing magazine and book racks are typically shipped fully assembled or in complete knockdown form, i.e., having many separate parts that are shipped in a carton and that must be assembled at a destination point. The full assembled free standing magazine and book racks are typically fully assembled at a manufacturing plant or point of origin and shipped fully assembly to a destination point. Knockdown magazine and book racks typically require substantial assembly, and are often difficult or too time consuming for average or unskilled buyers to assemble, especially in light of the numerous parts packaged in a knockdown magazine and book rack shipping carton and the complexity of assembly of all these parts.

For the foregoing reasons, there is a need for a knockdown magazine and book rack kit having at least one portion thereof prefabricated, in order to simplify and save assembly time. The knockdown magazine and book rack kit should also minimize packaging size and shipping costs.

The knockdown magazine and book rack kit should be capable of being manufactured, shipped and assembled in a quick, convenient, and efficient manner, and require a minimum of tools to assemble. Magazines and books should be capable of being displayed and distinguished one from the other and being accessed, removed, and stored quickly, and easily.

The knockdown magazine and book rack kit should be durable, light weight, inexpensive, safe to use, attractive, sturdy, and of simple construction, and should be capable of being manufactured, shipped, and assembled as a two sided knockdown magazine and book rack kit, having two prefabricated magazine and book racks, or as a single sided knockdown magazine and book rack kit, having one prefabricated magazine and book rack. Optional rear shelving should also be included for at least one embodiment of a single sided knockdown magazine and book rack kit, having the one prefabricated magazine and book rack.

The knockdown magazine and book rack kit should be capable of being shipped as a two sided knockdown magazine and book rack kit having two prefabricated rack sections that nest and interleave one with the other for quick, easy, and efficient packaging and shipment, which ensures that a shipping container containing parts for a two-sided knockdown magazine and book rack kit, having two prefabricated magazine and book racks, is approximately the same size as a shipping container for a single-sided knockdown magazine and book rack kit, having one prefabricated magazine and book rack.

SUMMARY

The present invention is directed to a knockdown magazine and book rack kit having at least one portion thereof prefabricated, in order to simplify and save assembly time. The knockdown magazine and book rack kit minimizes packaging size and shipping costs. The knockdown magazine and book rack kit may be manufactured, shipped and assembled in a quick, convenient, and efficient manner, and requires a minimum of tools to assemble. Magazines and books are capable of being displayed and distinguished one from the other and being accessed, removed, and stored quickly, and easily. The knockdown magazine and book rack kit is durable, light weight, inexpensive, safe to use, attractive, sturdy, and of simple construction.

A two-sided knockdown magazine and book rack kit has a pair of prefabricated wooden magazine and book racks, and nesting and interleaving the pair of prefabricated wooden magazine and book racks for packaging and shipping within a shipping container reduces shipping volume and size, and decreases shipping costs.

The knockdown magazine and book rack kit of present invention comprises but a few parts, wherein prefabricated rack sections are completely factory preassembled. The knockdown magazine and book rack kit is manufactured of wood or wood based products.

The two-sided knockdown magazine and book rack kit is shown as a preferred embodiment, whereas an alternate embodiment of a knockdown magazine and book rack kit is shown as a one-sided embodiment.

The two-sided knockdown magazine and book rack kit comprises two pre-drilled and formed substantially flat side panels, prefabricated wooden magazine and book racks, and a laterally directed substantially E shaped or C shaped channel member for receiving and holding uppermost portions of the prefabricated wooden magazine and book racks in place, the laterally directed substantially C shaped channel member removably fastened to each of the side panels at opposing ends thereof.

Protruding pegs attached to the side edges of each of the prefabricated wooden magazine and book racks quickly locate each rack in each side panel. Supplied screws then releasably lock the side panels and prefabricated wooden magazine and book racks together, while capturing the laterally directed substantially C shaped channel member.

Assembly of the knockdown magazine and book rack kit is a simple procedure, requiring a minimum number of steps, and results in a strong freestanding knockdown magazine and book rack.

In one of the alternate embodiments of the present invention, a single-sided magazine rack of similar construction comprises a single prefabricated wooden magazine and book rack section, two pre-drilled sides, an E shaped or C shaped channel member, and a rear panel.

It is should be noted that the two prefabricated rack sections nest and interleave one with the other for quick, easy, and efficient packaging and shipment, which ensures that a shipping container containing parts for a two-sided knockdown magazine and book rack kit of the present invention is approximately the same size as a shipping container for a single-sided knockdown magazine and book rack kit.

The interleaving of the nested shelving parts enables the parts to minimize space loss in shipping the three dimensional shelving parts of the rack. As a result the shelving components can be shipped swiftly within the standard 165 linear inch requirements of courier shipping, without the necessity of being shipped in bulk parcel post packaging at a longer delivery time.

In yet another alternate embodiment of the present invention, a single-sided magazine rack of similar construction comprises a single prefabricated wooden magazine and book rack section, two pre-drilled sides, a top panel, an intermediate panel, and at least one shelf.

A knockdown magazine and book rack kit having features of the present invention comprises: a pair of prefabricated wooden magazine and book racks, each of the prefabricated wooden magazine and book racks constructed of a plurality of substantially upright panels, a plurality of laterally directed shelves, a lower substantially upright front panel, and an upper substantially upright rear panel, forming a plurality of substantially J shaped channels for holding books and magazines therein, each of the plurality of substantially upright panels forming the rear portion of one of the substantially J shaped channels and the front portion of an adjacent one of the substantially J shaped channels, each of the plurality of substantially upright panels having one of the plurality of shelves substantially perpendicularly fastened thereto at a lower portion thereof and an adjacent one of the plurality of shelves substantially perpendicularly fastened thereto at an intermediate portion thereof, the upper substantially upright rear panel having an uppermost one of the plurality of shelves substantially perpendicularly fastened thereto at a lower portion thereof, the lower substantially upright front panel having a lowermost one of the plurality of shelves substantially perpendicularly fastened thereto at a lower portion thereof; a pair of wooden substantially symmetrical hexagonal shaped opposing side panels substantially perpendicularly removably fastened to the pair of prefabricated wooden magazine and book racks one to the other, each of the wooden substantially symmetrical hexagonal shaped opposing side panels having a top portion and a base portion substantially parallel one to the other, the base portion wider than the top portion, substantially parallel lower opposing side portions substantially perpendicular to the base portion, and a pair of angularly disposed upper side portions; a laterally directed substantially E shaped channel member receiving uppermost portions of each of the upper substantially upright rear panels of the pair of prefabricated wooden magazine and book racks therein, the laterally directed substantially E shaped channel member having opposing ends removably fastened to the wooden substantially symmetrical hexagonal shaped opposing side panels and holding the upper substantially upright rear panels of the pair of prefabricated wooden magazine and book racks in place.

DRAWINGS

These and other features, aspects, and advantages of the present invention will become better understood with regard to the following description, appended claims, and accompanying drawings where:

DESCRIPTION

Figure 1:
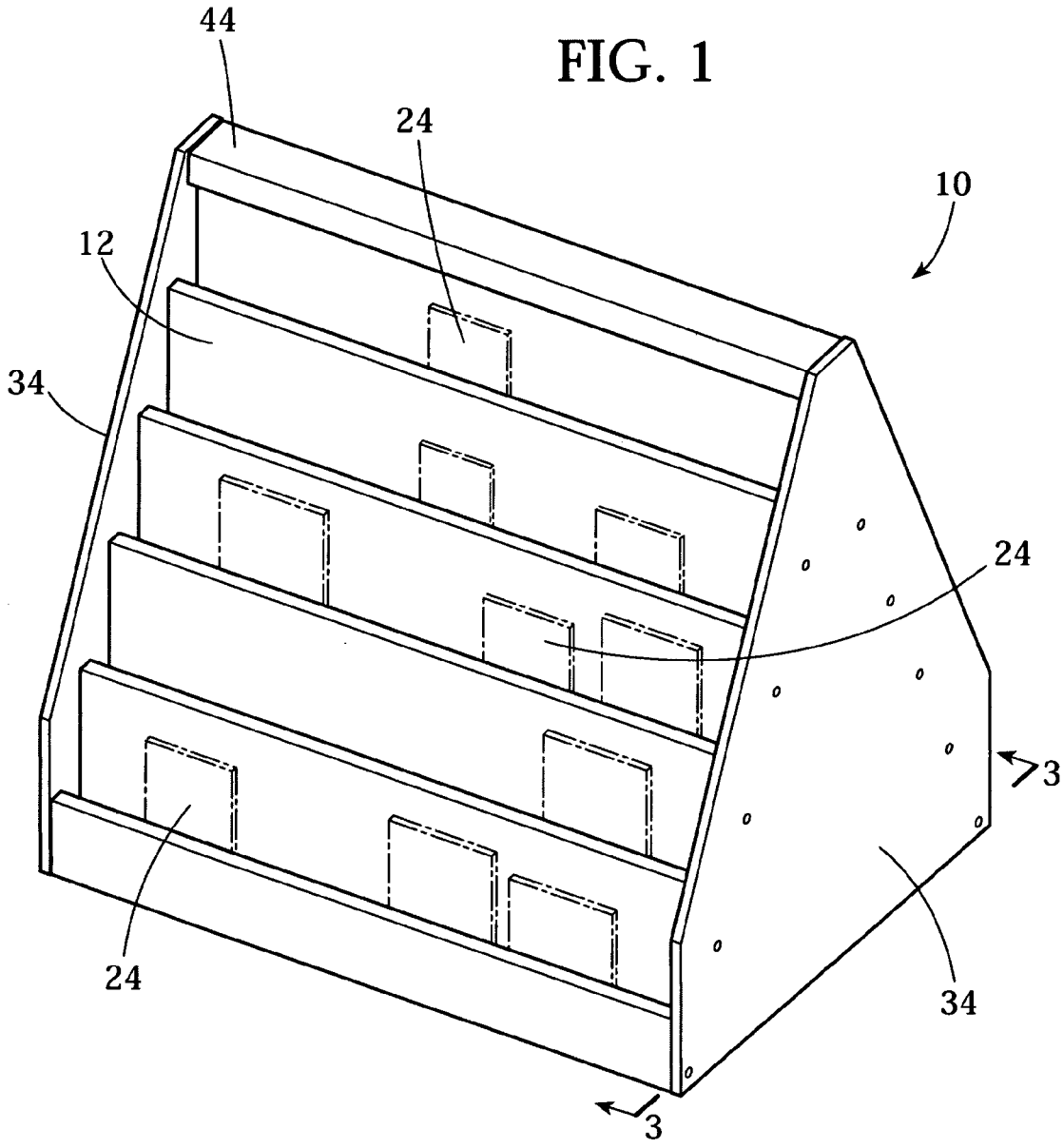
FIG. 1 is a perspective view of a knockdown magazine and book rack kit, constructed in accordance with the present invention.
Figure 2:
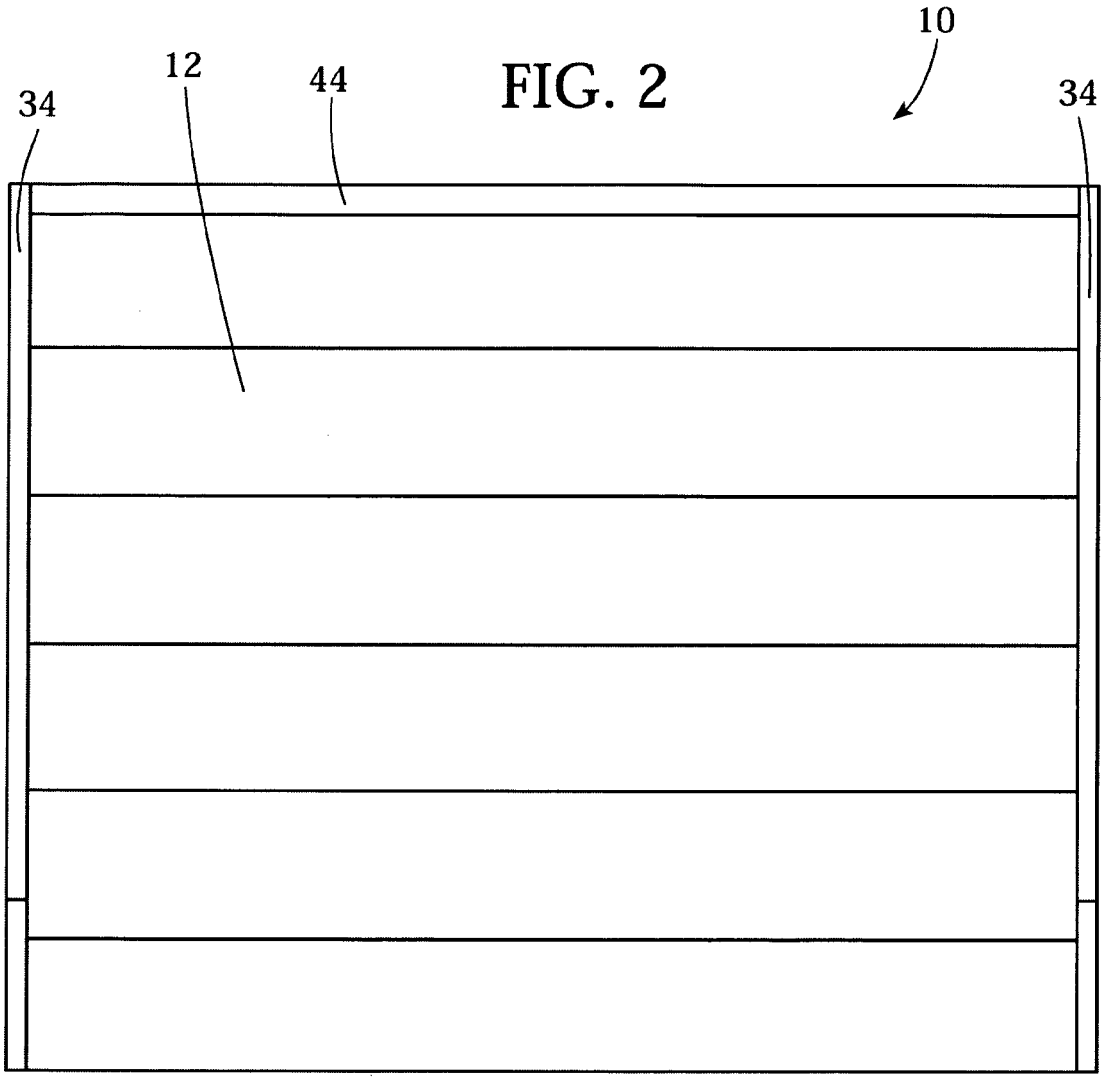
FIG. 2 is a front view of the knockdown magazine and book rack kit of FIG. 1.
Figure 3:
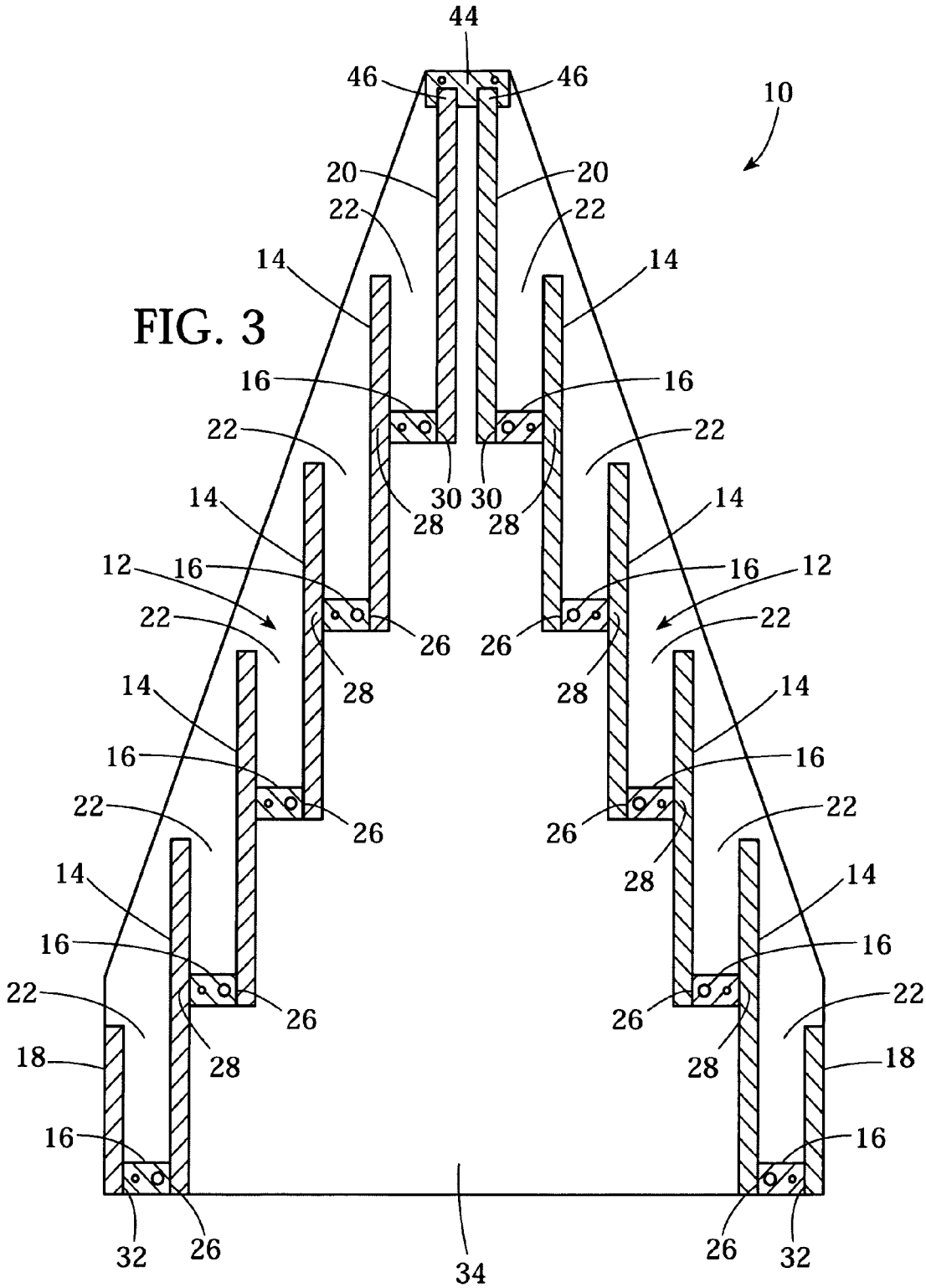
FIG. 3 is a cross section view of the knockdown magazine and book rack kit of FIG. 1.
Figure 4:
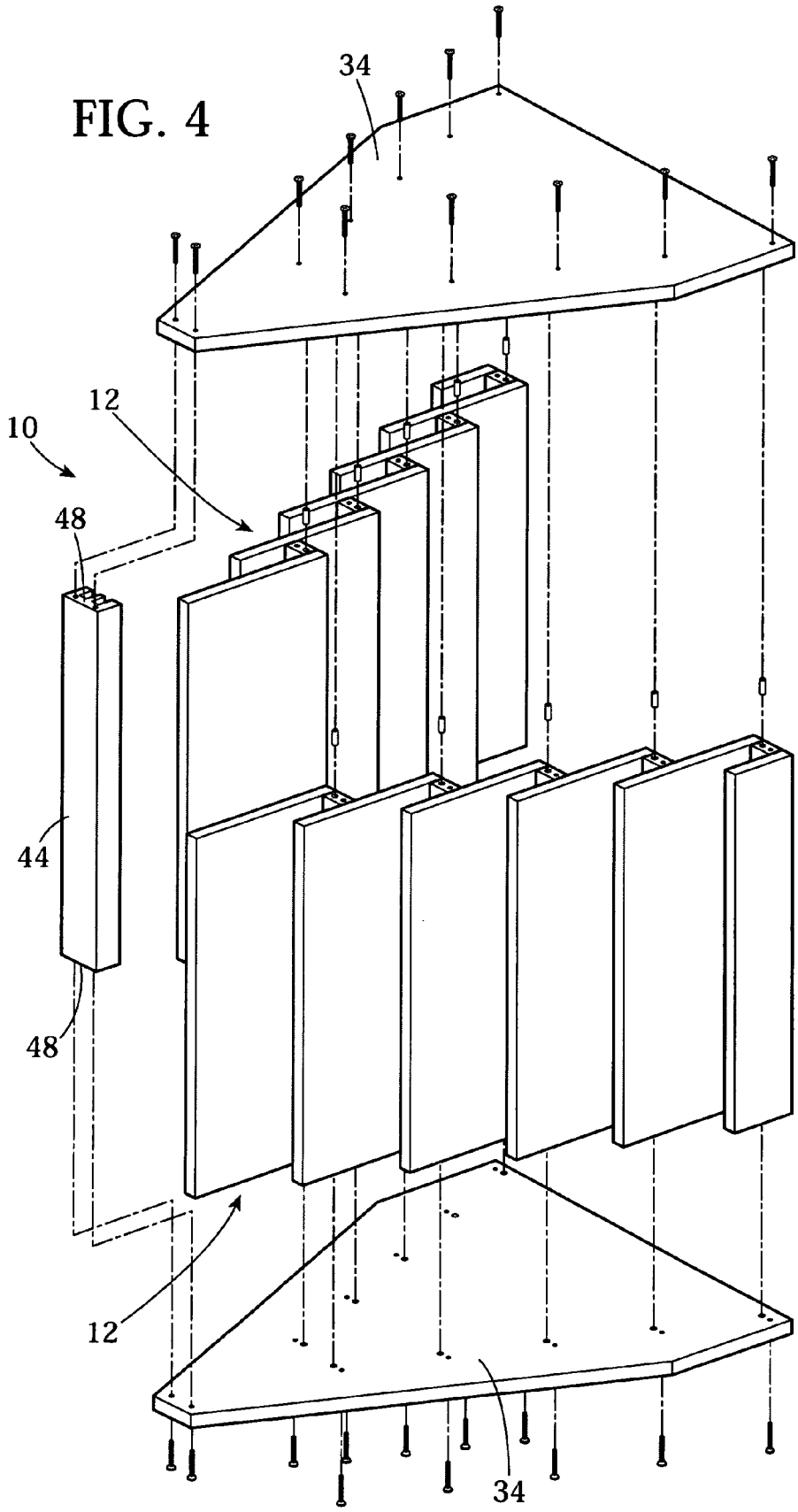
FIG. 4 is an exploded view of the knockdown magazine and book rack kit of FIG. 1.
Figure 5:
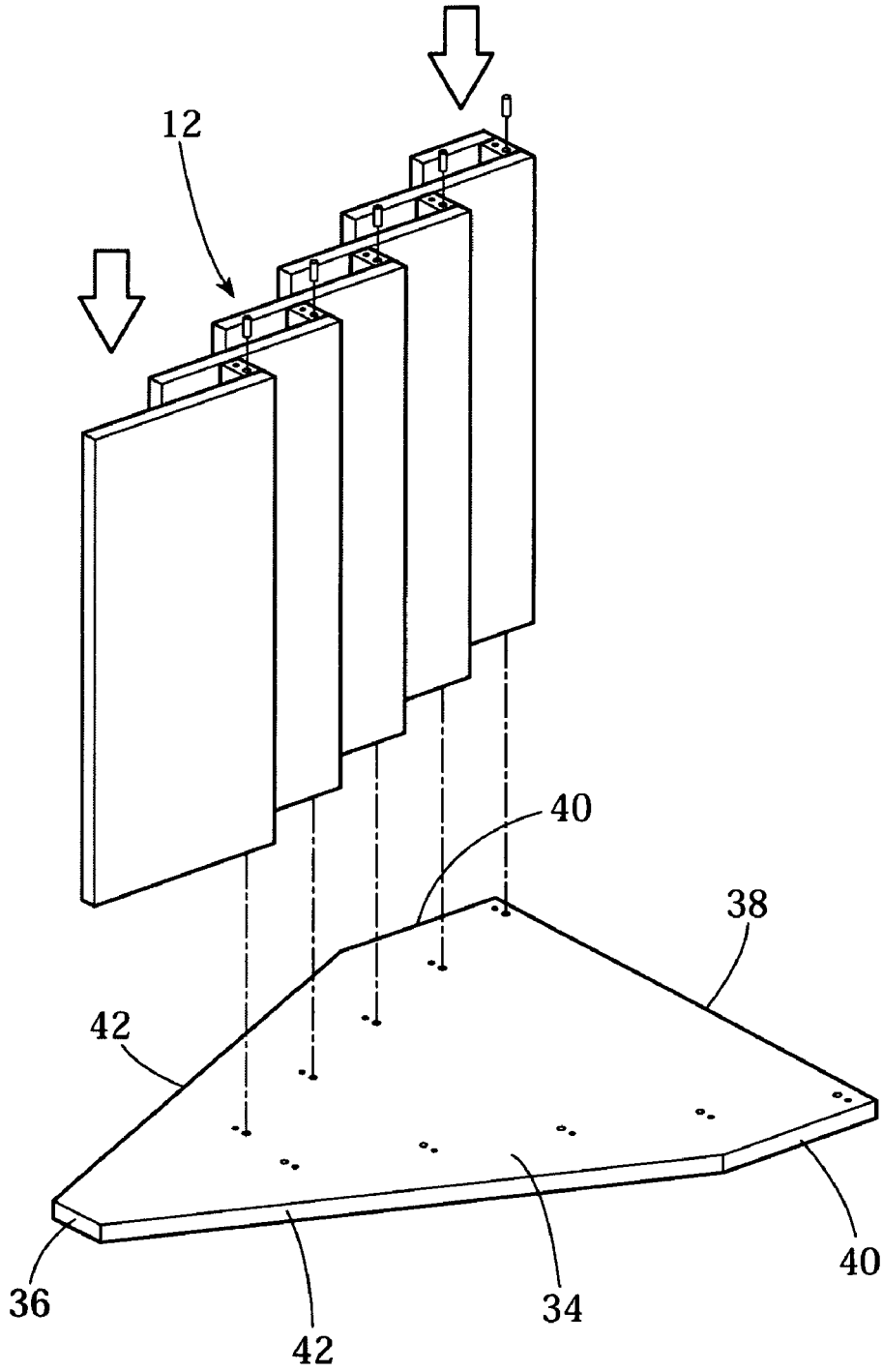
FIG. 5 is an exploded view of an alternate embodiment of a knockdown magazine and book rack kit of FIG. 1 partially assembled, shown during a step of assembly of the knockdown magazine and book rack kit.
Figure 6:
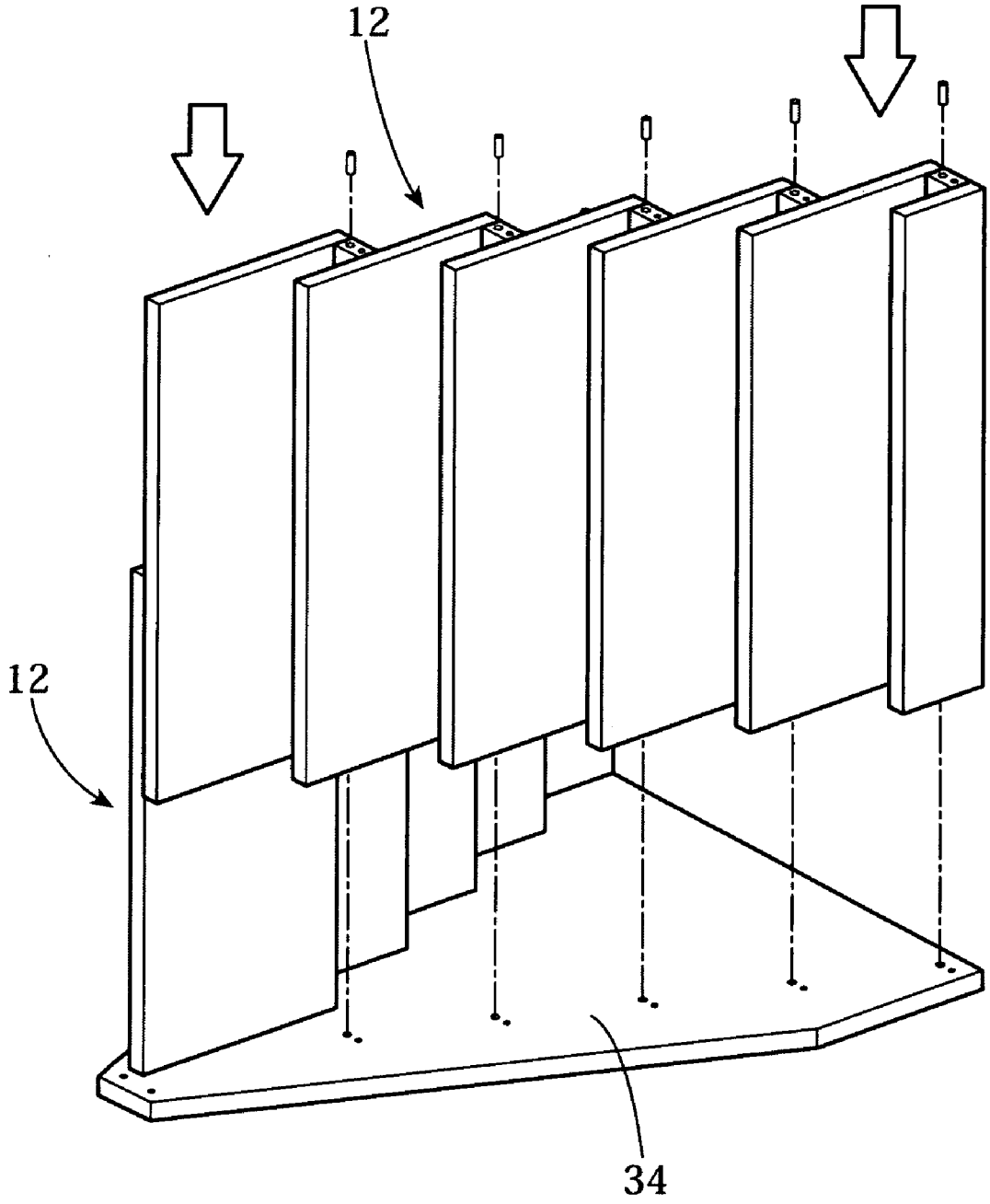
FIG. 6 is an exploded view of the alternate embodiment of the knockdown magazine and book rack kit of FIG. 5, partially assembled shown during another step of assembly of the knockdown magazine and book rack kit.
Figure 7:
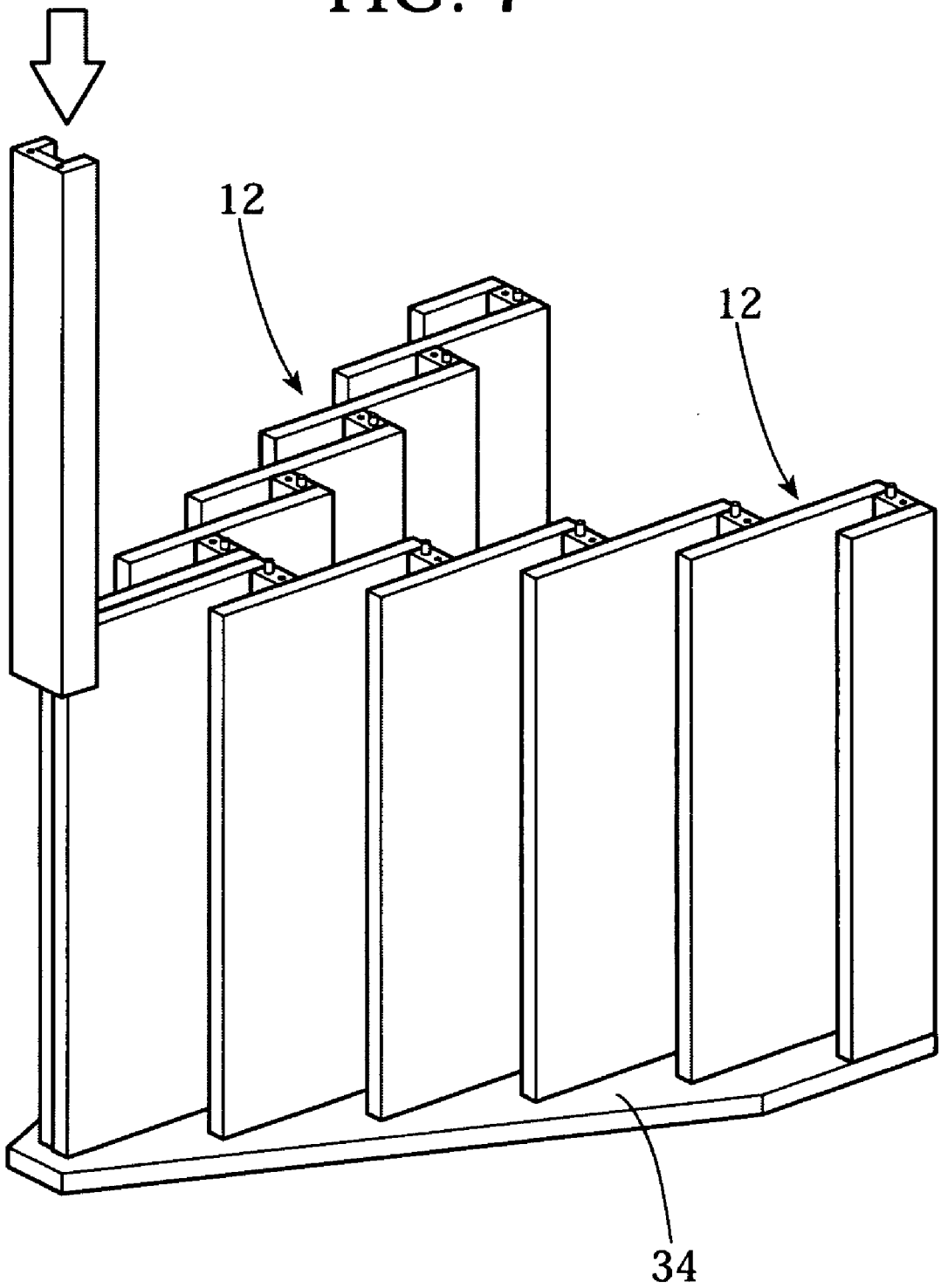
FIG. 7 is an exploded view of the alternate embodiment of the knockdown magazine and book rack kit of FIG. 5, partially assembled shown during another step of assembly of the knockdown magazine and book rack kit.
Figure 8:
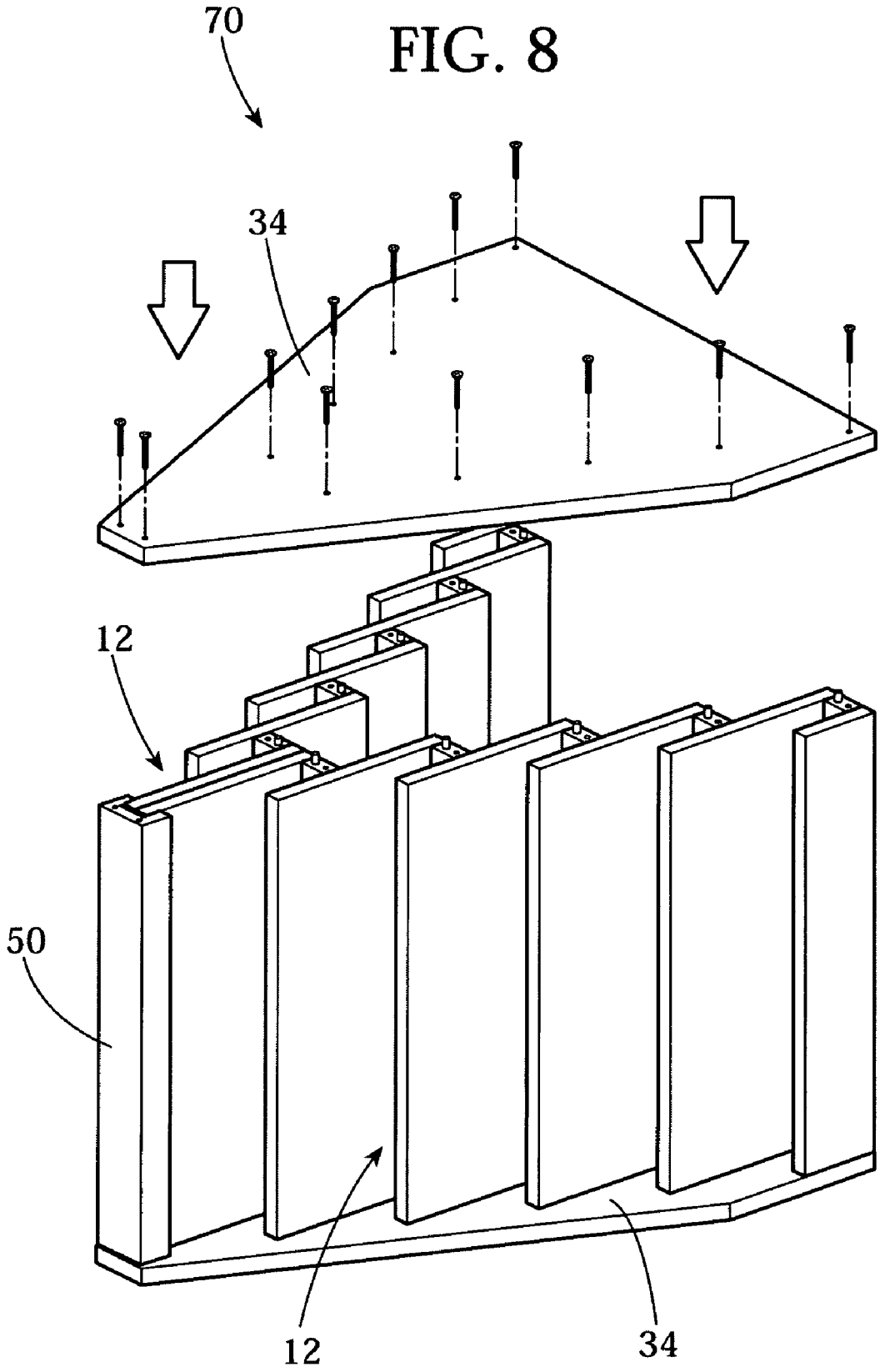
FIG. 8 is an exploded view of the alternate embodiment of the knockdown magazine and book rack kit of FIG. 5, shown during another step of assembly of the knockdown magazine and book rack kit.
Figure 9:
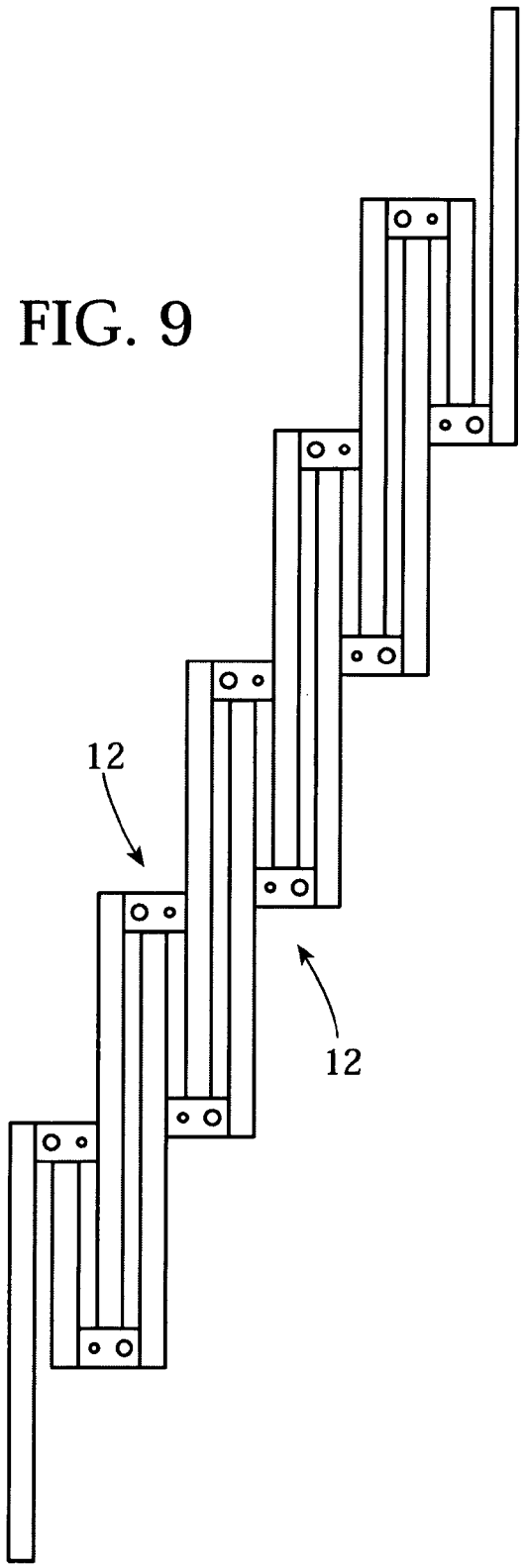
FIG. 9 is a side view of a pair of prefabricated magazine and book racks of the knockdown magazine and book rack kit of FIG. 1 nested and interleaved for shipment.
Figure 10:
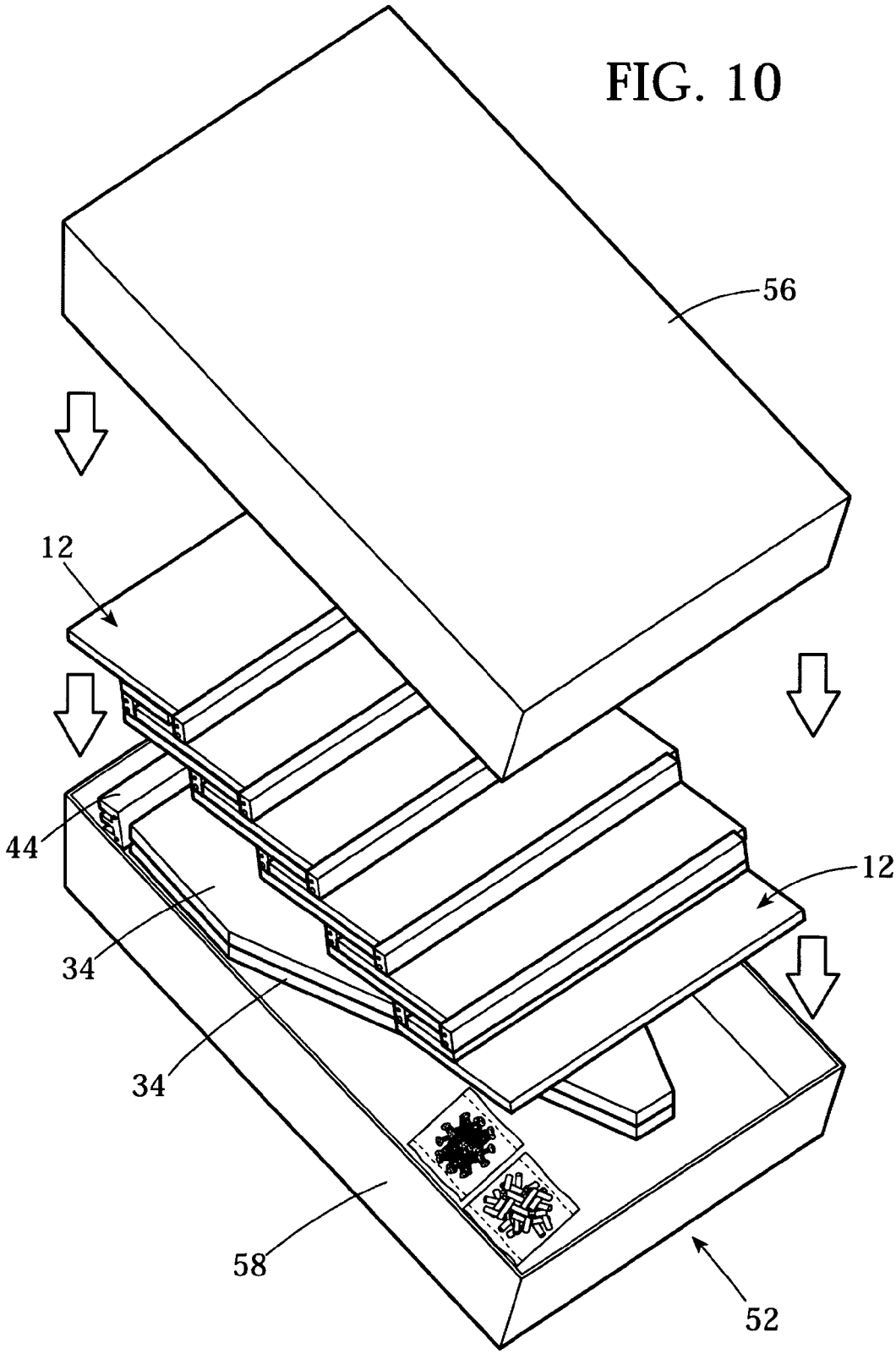
FIG. 10 is a top perspective view of the pair of prefabricated magazine and book racks of the knockdown magazine and book rack kit of FIG. 1 showing the nested and interleaved prefabricated magazine and book racks of FIG. 9 and other parts of the knockdown magazine and book rack kit being packaged in a shipping container for shipment.
Figure 11:
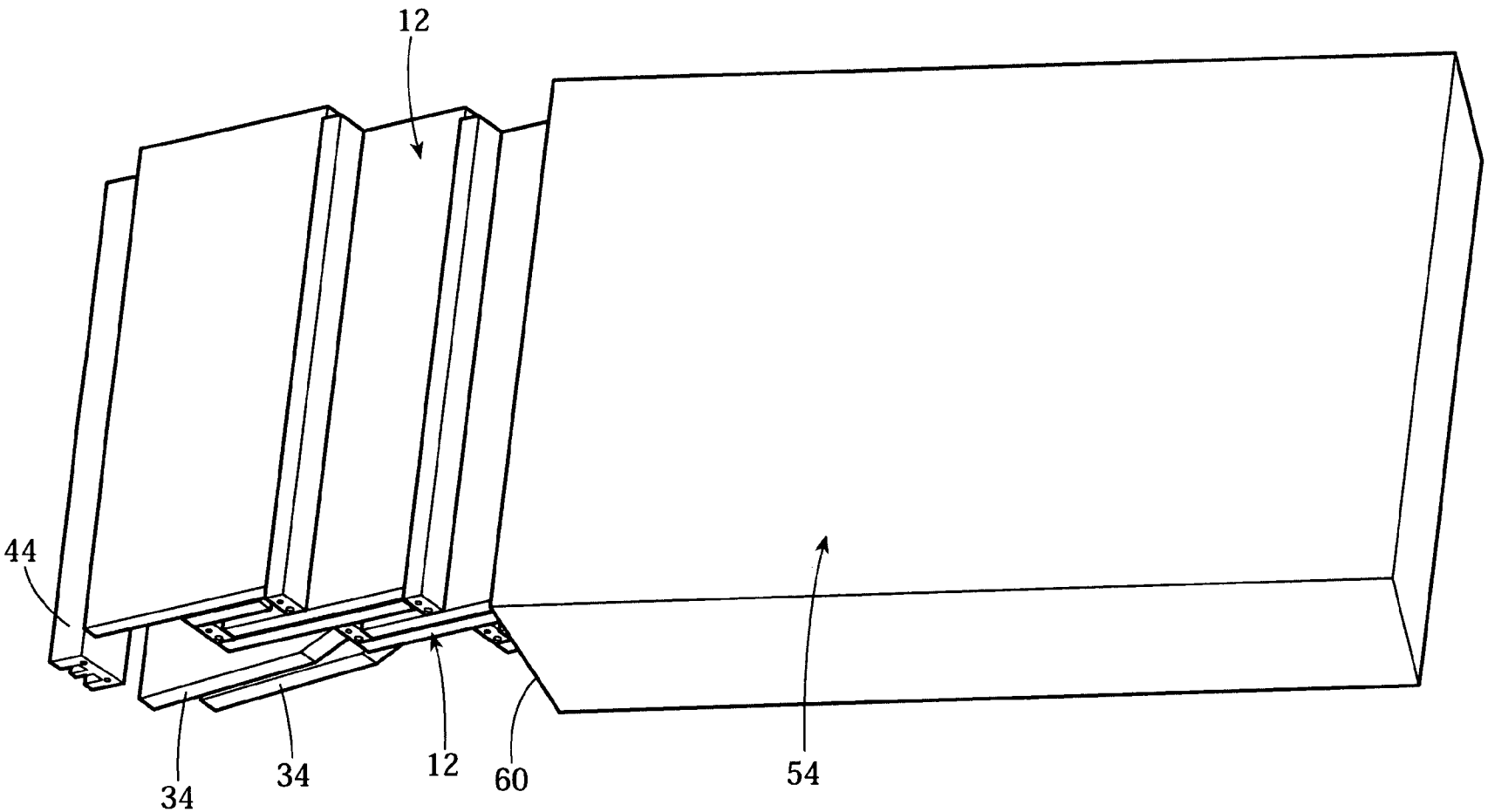
FIG. 11 is a perspective view of a pair of prefabricated magazine and book racks of the knockdown magazine and book rack kit of FIG. 1 showing the nested and interleaved prefabricated magazine and book racks of FIG. 9 of the knockdown magazine and book rack kit being packaged in an alternative shipping container for shipment.
Figure 12:
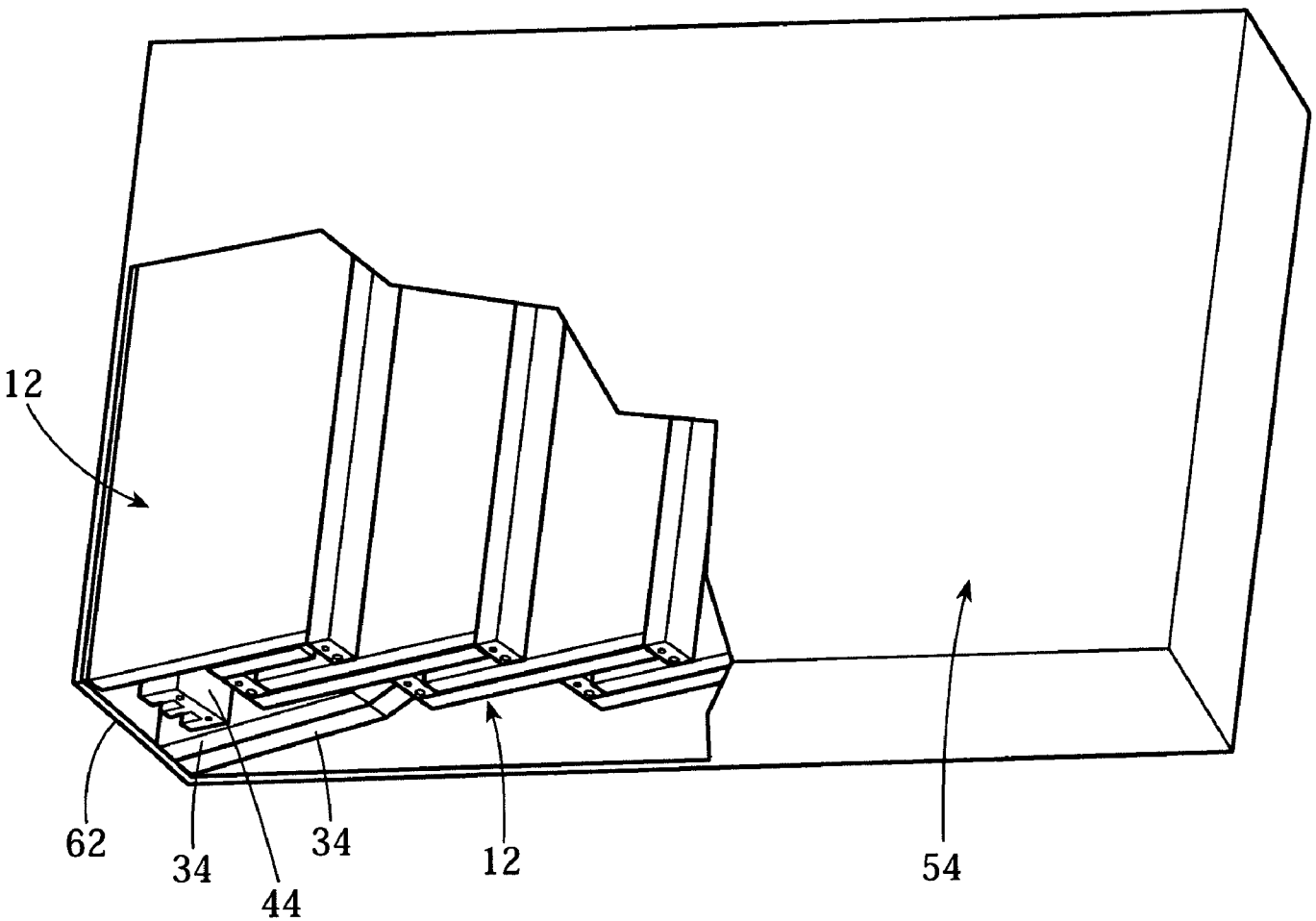
FIG. 12 is a breakaway perspective view of the pair of prefabricated magazine and book racks of the knockdown magazine and book rack kit of FIG. 1 showing the nested and interleaved prefabricated magazine and book racks packaged within the alternative shipping container of FIG. 11 for shipment.

The preferred embodiments of the present invention will be described with reference to FIGS. 1-19 of the drawings. Identical elements in the various figures are identified with the same reference numbers.

FIGS. 1-12 show an embodiment of the present invention a knockdown magazine and book rack kit 10. FIGS. 1-4 show perspective, front, cross section, and exploded views of the knockdown magazine and book rack kit 10, respectively. FIGS. 5-8 show steps of assembly of an alternate embodiment of a knockdown magazine and book rack kit 100, which is substantially the same as the knockdown magazine and book rack kit 10 except that the alternate embodiment of the knockdown magazine and book rack kit 100 has a different embodiment of a laterally directed channel member. FIGS. 9-12 show nesting and interleaving of prefabricated wooden magazine and book racks 12 of the knockdown magazine and book rack kit 10 and packaging in alternate shipping containers.

FIGS. 1-4 show the knockdown magazine and book rack kit 10, comprising: a pair of the prefabricated wooden magazine and book racks 12, each of the prefabricated wooden magazine and book racks 12 constructed of a plurality of substantially upright panels 14, a plurality of laterally directed shelves 16, a lower substantially upright front panel 18, and an upper substantially upright rear panel 20, forming a plurality of substantially J shaped channels 22 for holding books and magazines 24 therein, each of the plurality of substantially upright panels 14 forming the rear portion of one of the substantially J shaped channels 22 and the front portion of an adjacent one of the substantially J shaped channels 22, each of the plurality of substantially upright panels 14 having one of the plurality of shelves 16 substantially perpendicularly fastened thereto at a lower portion 26 thereof and an adjacent one of the plurality of shelves substantially perpendicularly fastened thereto at an intermediate portion 28 thereof, the upper substantially upright rear panel 20 having an uppermost one of the plurality of shelves 16 substantially perpendicularly fastened thereto at a lower portion 30 thereof, the lower substantially upright front panel 18 having a lowermost one of the plurality of shelves 16 substantially perpendicularly fastened thereto at a lower portion 32 thereof; a pair of wooden substantially symmetrical hexagonal shaped opposing side panels 34 substantially perpendicularly removably fastened to the pair of prefabricated wooden magazine and book racks 12 one to the other, each of the wooden substantially symmetrical hexagonal shaped opposing side panels 34 having a top portion 36 and a base portion 38 substantially parallel one to the other, the base portion 38 wider than the top portion 36, substantially parallel lower opposing side portions 40 substantially perpendicular to the base portion 38, and a pair of angularly disposed upper side portions 42; a laterally directed substantially E shaped channel member 44 receiving uppermost portions 46 of each of the upper substantially upright rear panels 20 of the pair of prefabricated wooden magazine and book racks therein 12, the laterally directed substantially E shaped channel member 44 having opposing ends 48 removably fastened to the wooden substantially symmetrical hexagonal shaped opposing side panels 34 and holding the upper substantially upright rear panels 20 of the pair of prefabricated wooden magazine and book racks 12 in place.

FIGS. 5-8 show steps of assembly of an alternate embodiment of a knockdown magazine and book rack kit 70, which is substantially the same as the knockdown magazine and book rack kit 10, except that the alternate embodiment of a knockdown magazine and book rack kit 70 has a laterally directed substantially C shaped channel member 50, which may be used as an alternate embodiment of the laterally directed substantially E shaped channel member 44 to hold the upper substantially upright rear panels 20 of the pair of prefabricated wooden magazine and book racks 12 in place.

FIGS. 9-12 show nesting and interleaving of prefabricated wooden magazine and book racks 12 of the knockdown magazine and book rack kit 10 and packaging in alternate shipping containers 52 and 54. The shipping container 52 has upper portion 56 and lower portion 58, allowing the knockdown magazine and book rack kit 10 to be dropped into the lower portion 58 of the shipping container 52. The upper portion 56 is then used to cover the lower portion 58 and enclose the knockdown magazine and book rack kit 10 within the shipping container 52. The shipping container 54 has opening 60, which may be closed with hinged lid 62, to enclose the he knockdown magazine and book rack kit 10 within the shipping container 54.

Figure 13:
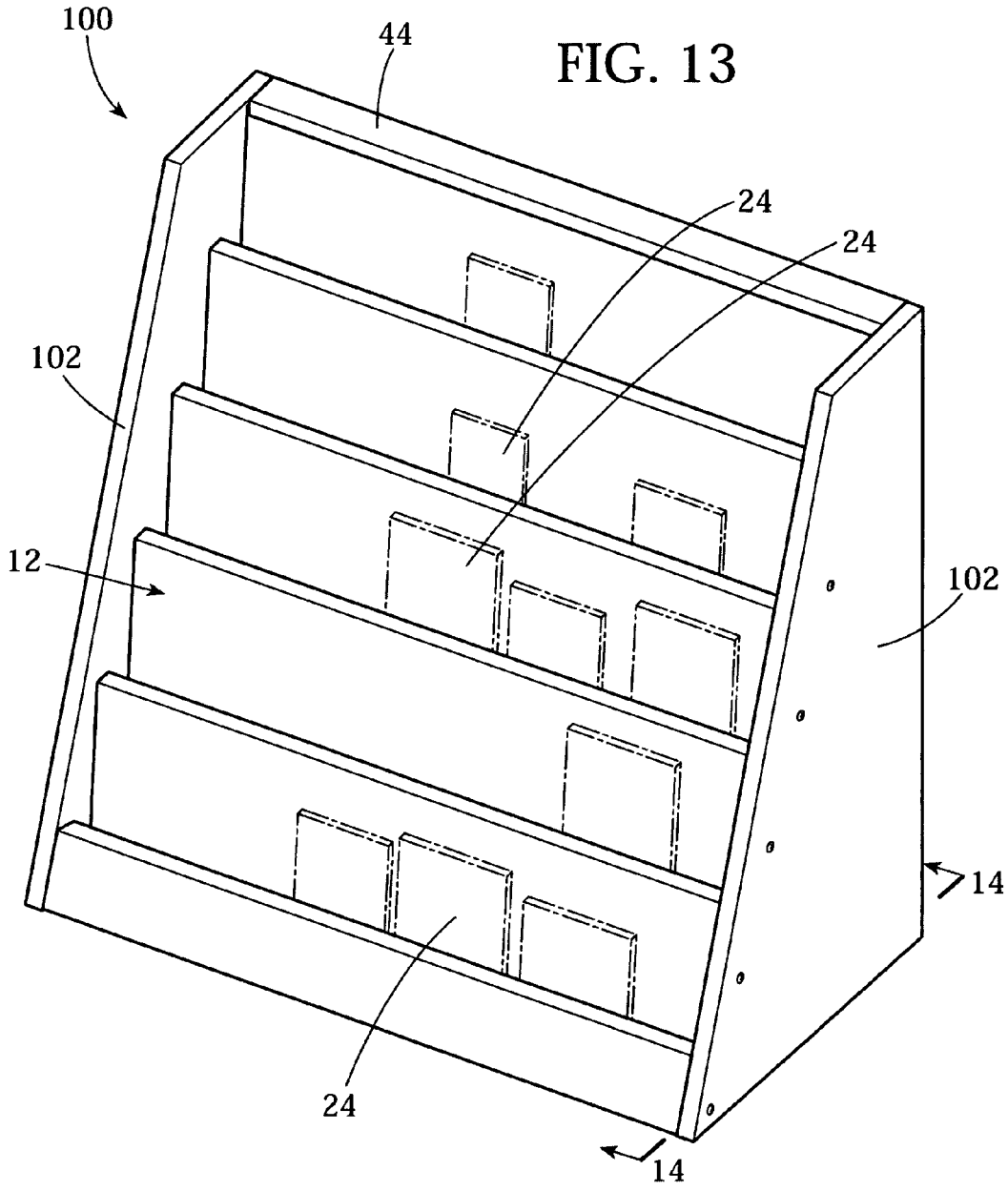
FIG. 13 is a perspective view of an alternate embodiment of a knockdown magazine and book rack kit, constructed in accordance with the present invention.
Figure 14:
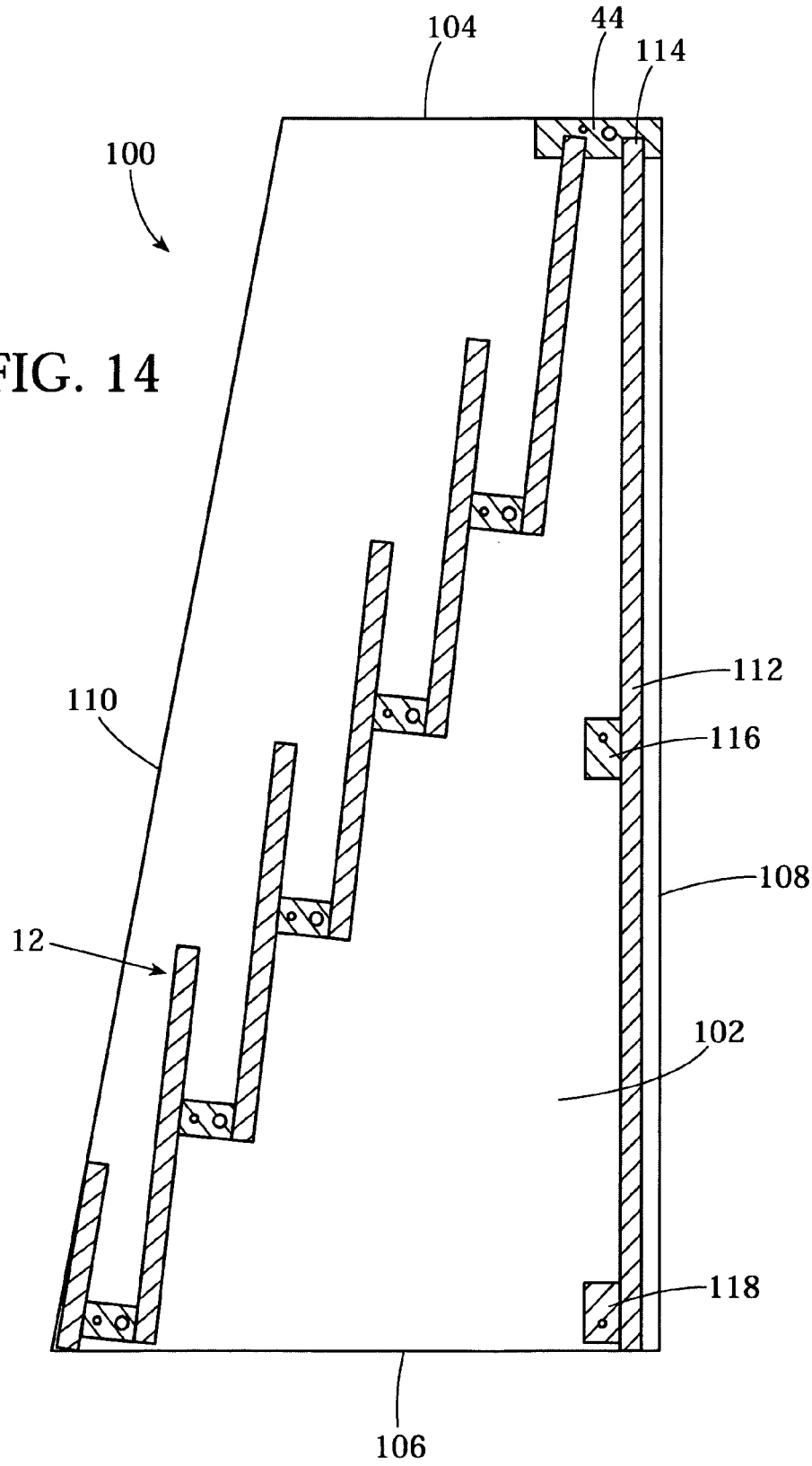
FIG. 14 is a cross section view of the alternate embodiment of the knockdown magazine and book rack kit of FIG. 13.
Figure 15:
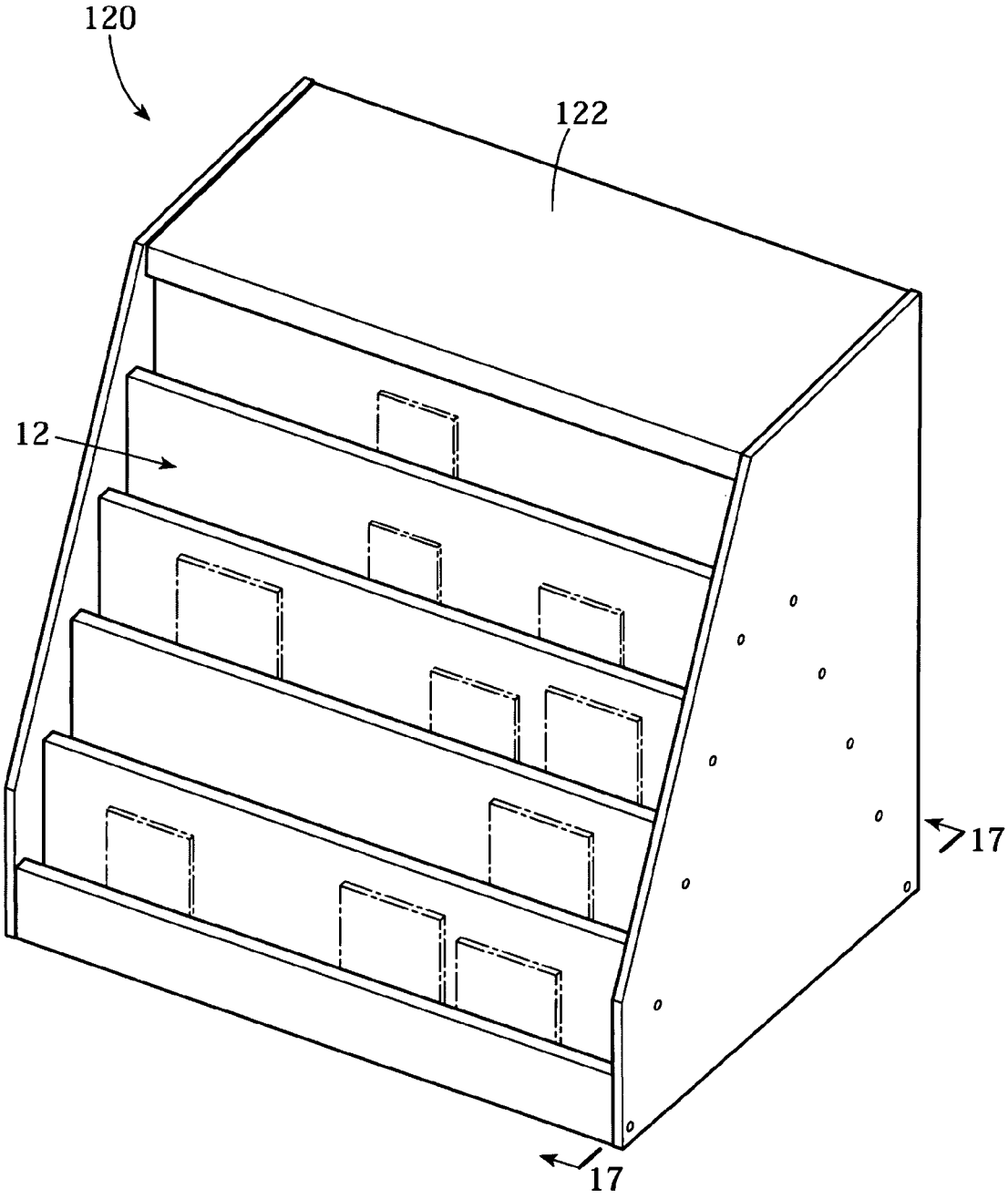
FIG. 15 is a front perspective view of another alternate embodiment of a knockdown magazine and book rack kit, constructed in accordance with the present invention.
Figure 16:
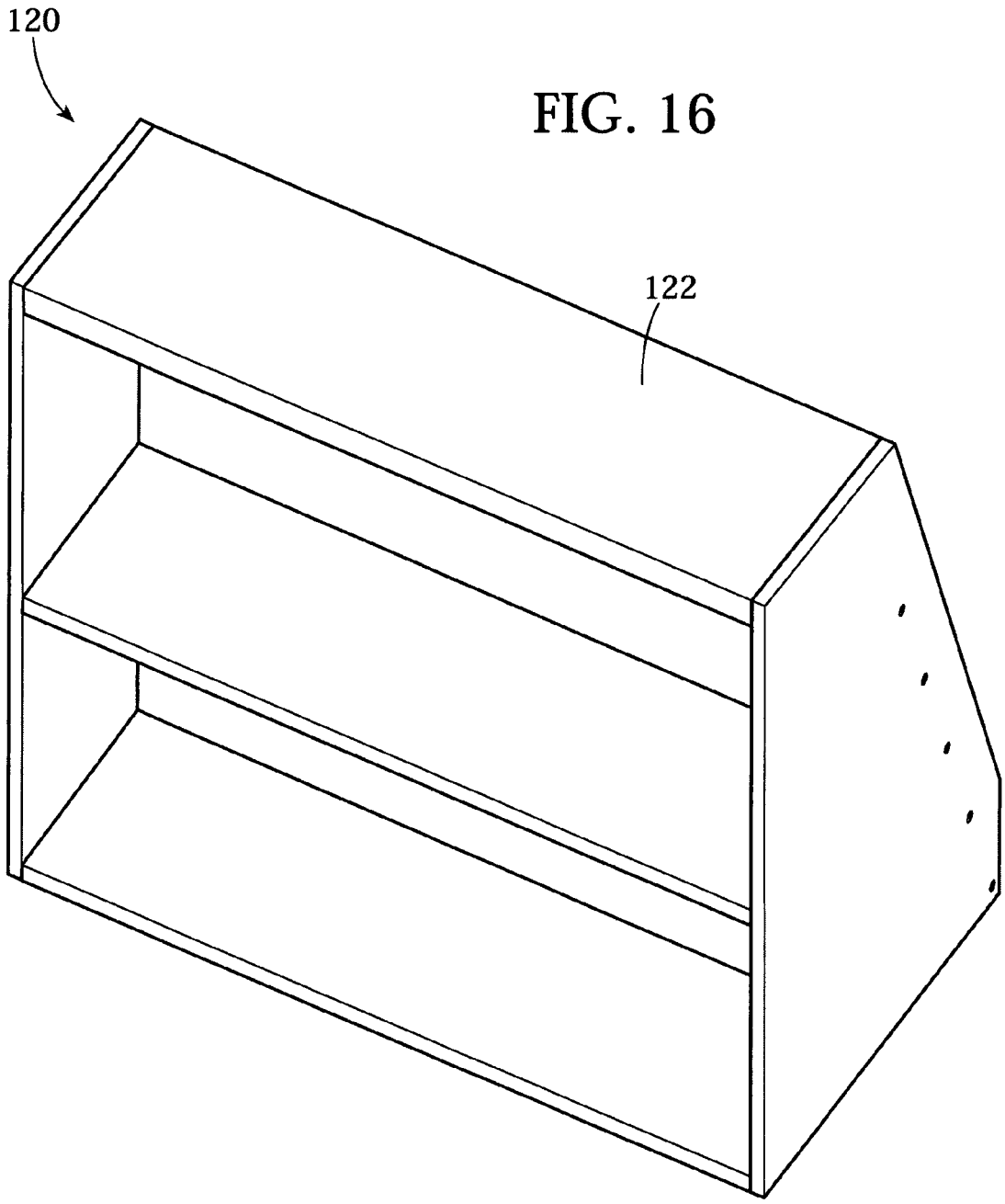
FIG. 16 is a rear perspective view of the alternate embodiment of the knockdown magazine and book rack kit of FIG. 15.
Figure 17:
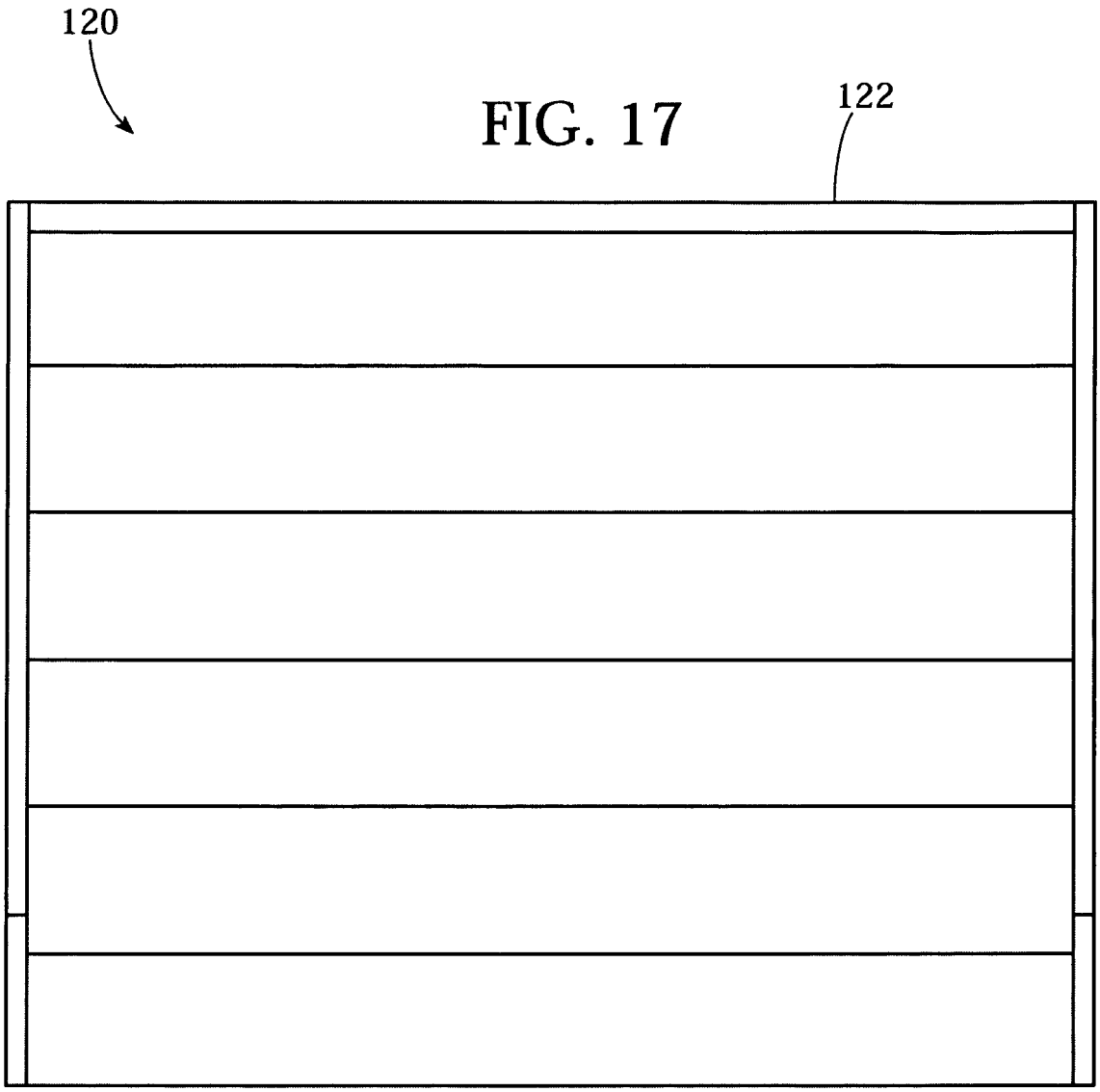
FIG. 17 is a front view of the alternate embodiment of the knockdown magazine and book rack kit of FIG. 15.
Figure 18:
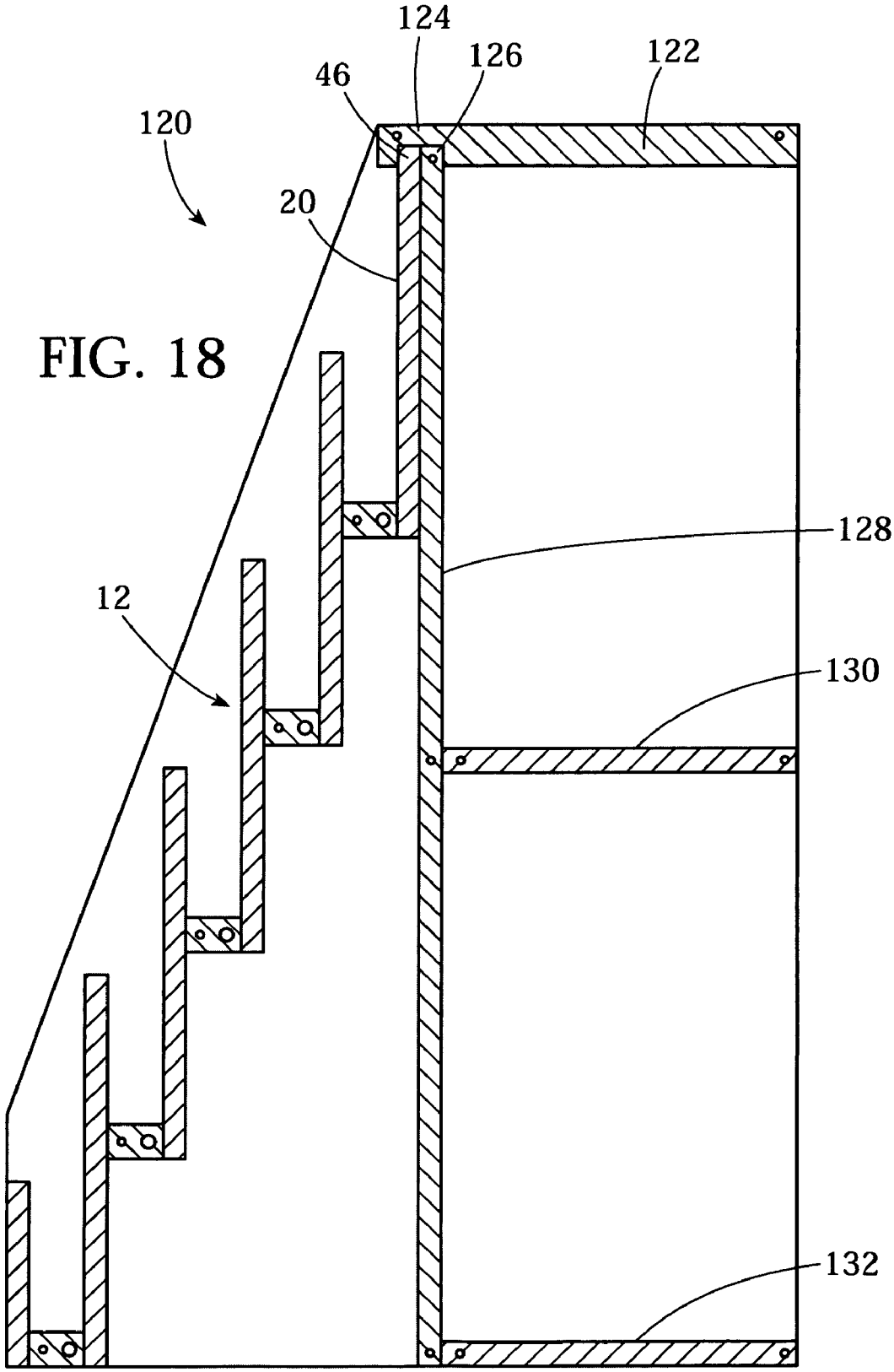
FIG. 18 is a cross section view of the alternate embodiment of the knockdown magazine and book rack kit of FIG. 15.
Figure 19:
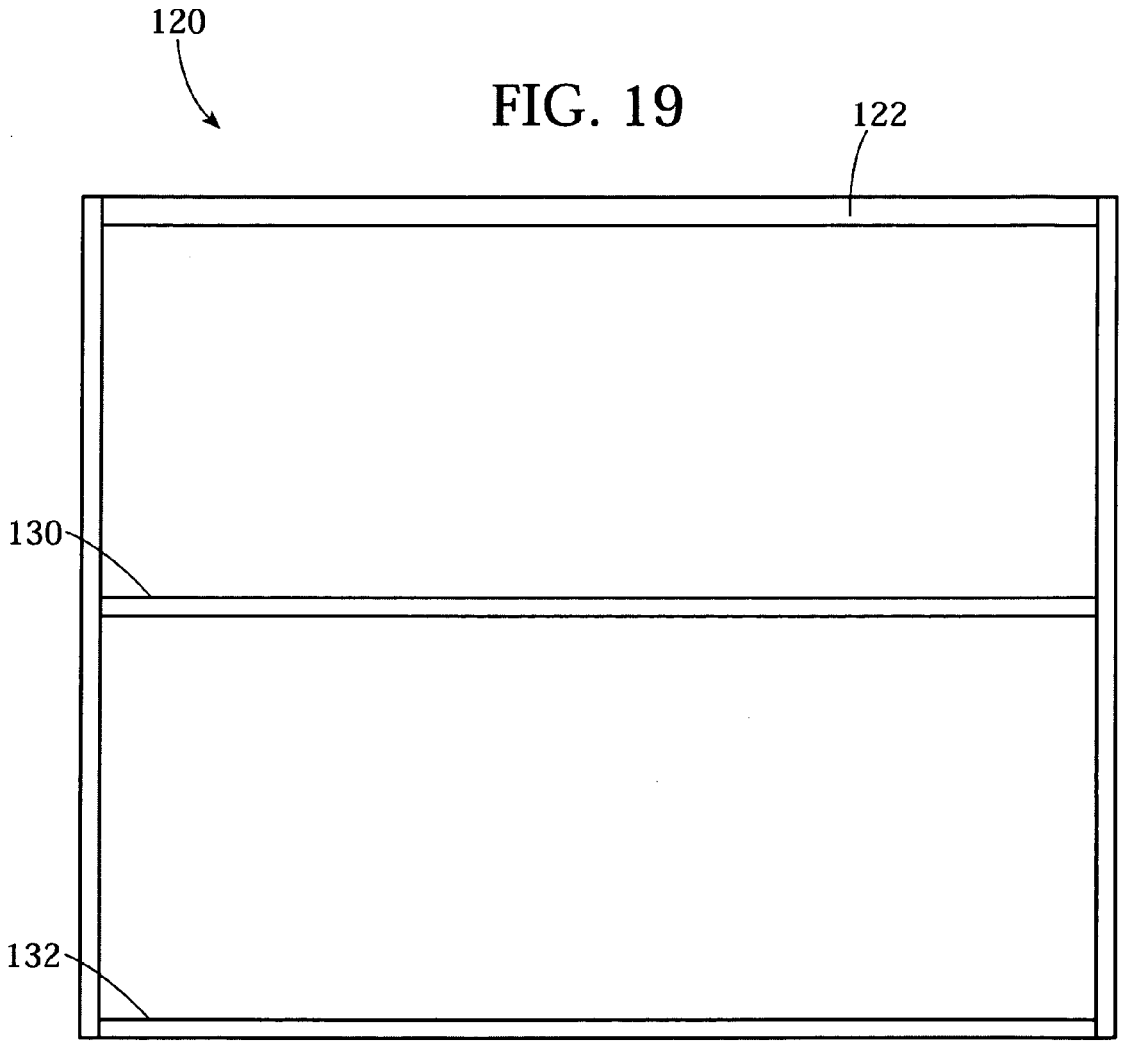
FIG. 19 is a rear view of the alternate embodiment of the knockdown magazine and book rack kit of FIG. 15.

FIGS. 13 and 14 show an alternate embodiment of a knockdown magazine and book rack kit 100, which has one of the prefabricated wooden magazine and book racks 12, whereas the knockdown magazine and book rack kit 10 and the knockdown magazine and book rack kit 70 each have a pair of the prefabricated wooden magazine and book racks 12 in a back-to-back configuration. The knockdown magazine and book rack kit 100 also has the substantially E shaped channel member 44, although the substantially C shaped channel member 50 may alternately be used.

The knockdown magazine and book rack kit 100 has a pair of wooden substantially trapezoid shaped opposing side panels 102 substantially perpendicularly removably fastened to the prefabricated wooden magazine and book rack 12 one to the other, each of the wooden substantially trapezoid shaped opposing side panels 102 having a top portion 104 and a base portion 106 substantially parallel one to the other, the base portion 106 wider than the top portion 104, a substantially upright rear side portion 108 substantially perpendicular to the base portion 106, and an angularly disposed front side portion 110; a substantially upright rear panel 112, the pair of wooden substantially trapezoid shaped opposing side panels 102 substantially perpendicularly removably fastened to the substantially upright rear panel 112 one to the other. The laterally directed substantially E shaped channel member 44 receives the uppermost portion 46 of the upper substantially upright rear panel 20 of the prefabricated wooden magazine and book rack 12 and an uppermost portion 114 of the substantially upright rear panel 112 therein. The knockdown magazine and book rack kit 100 may also have upper and lower lateral reinforcing members 116 and 118, respectively, to reinforce and hold the substantially upright rear panel 112 between the wooden substantially trapezoid shaped opposing side panels 102.

FIGS. 15-19 show an alternate embodiment of a knockdown magazine and book rack kit 120, which also has one of the prefabricated wooden magazine and book racks 12. The knockdown magazine and book rack kit 120 has a wooden top panel 122 having a forwardly disposed laterally directed substantially C shaped channel 124 receiving an uppermost portion 46 of the upper substantially upright rear panel 20 of the prefabricated wooden magazine and book rack 12 and an uppermost portion 126 of a substantially upright intermediate panel 128 therein. The knockdown magazine and book rack kit 120 also has at least one rear shelf, which may comprise an intermediate height rear shelf 130 and/or a lower rear shelf 132.

Although the present invention has been described in considerable detail with reference to certain preferred versions thereof, other versions are possible. Therefore, the spirit and scope of the appended claims should not be limited to the description of the preferred versions contained herein.

What is claimed is:

1. A knockdown magazine and book rack kit, comprising:

a pair of prefabricated wooden magazine and book racks, each of the prefabricated wooden magazine and book racks constructed of a plurality of substantially upright panels, a plurality of laterally directed shelves, a lower substantially upright front panel, and an upper substantially upright rear panel, forming a plurality of substantially J shaped channels for holding books and magazines therein, each of the plurality of substantially upright panels forming the rear portion of one of the substantially J shaped channels and the front portion of an adjacent one of the substantially J shaped channels, each of the plurality of substantially upright panels having one of the plurality of shelves substantially perpendicularly fastened thereto at a lower portion thereof and an adjacent one of the plurality of shelves substantially perpendicularly fastened thereto at an intermediate portion thereof, the upper substantially upright rear panel having an uppermost one of the plurality of shelves substantially perpendicularly fastened thereto at a lower portion thereof, the lower substantially upright front panel having a lowermost one of the plurality of shelves substantially perpendicularly fastened thereto at a lower portion thereof;

a pair of wooden substantially symmetrical hexagonal shaped opposing side panels substantially perpendicularly removably fastened to the pair of prefabricated wooden magazine and book racks one to the other, each of the wooden substantially symmetrical hexagonal shaped opposing side panels having a top portion and a base portion substantially parallel one to the other, the base portion wider than the top portion, substantially parallel lower opposing side portions substantially perpendicular to the base portion, and a pair of angularly disposed upper side portions;

a laterally directed substantially E shaped channel member receiving uppermost portions of each of the upper substantially upright rear panels of the pair of prefabricated wooden magazine and book racks therein, the laterally directed substantially E shaped channel member having opposing ends removably fastened to the wooden substantially symmetrical hexagonal shaped opposing side panels and holding the upper substantially upright rear panels of the pair of prefabricated wooden magazine and book racks in place.

2. A knockdown magazine and book rack kit, comprising:

a pair of prefabricated wooden magazine and book racks, each of the prefabricated wooden magazine and book racks constructed of a plurality of substantially upright panels, a plurality of laterally directed shelves, a lower substantially upright front panel, and an upper substantially upright rear panel, forming a plurality of substantially J shaped channels for holding books and magazines therein, each of the plurality of substantially upright panels forming the rear portion of one of the substantially J shaped channels and the front portion of an adjacent one of the substantially J shaped channels, each of the plurality of substantially upright panels having one of the plurality of shelves substantially perpendicularly fastened thereto at a lower portion thereof and an adjacent one of the plurality of shelves substantially perpendicularly fastened thereto at an intermediate portion thereof, the upper substantially upright rear panel having an uppermost one of the plurality of shelves substantially perpendicularly fastened thereto at a lower portion thereof, the lower substantially upright front panel having a lowermost one of the plurality of shelves substantially perpendicularly fastened thereto at a lower portion thereof;

a pair of wooden substantially symmetrical hexagonal shaped opposing side panels substantially perpendicularly removably fastened to the pair of prefabricated wooden magazine and book racks one to the other, each of the wooden substantially symmetrical hexagonal shaped opposing side panels having a top portion and a base portion substantially parallel one to the other, the base portion wider than the top portion, substantially parallel lower opposing side portions substantially perpendicular to the base portion, and a pair of angularly disposed upper side portions;

a laterally directed substantially C shaped channel member receiving uppermost portions of each of the upper substantially upright rear panels of the pair of prefabricated wooden magazine and book racks therein, the laterally directed substantially C shaped channel member having opposing ends removably fastened to the wooden substantially symmetrical hexagonal shaped opposing side panels and holding the upper substantially upright rear panels of the pair of prefabricated wooden magazine and book racks in place.

3. A knockdown magazine and book rack kit, comprising:

a prefabricated wooden magazine and book rack, the prefabricated wooden magazine and book rack constructed of a plurality of substantially upright panels, a plurality of laterally directed shelves, a lower substantially upright front panel, and an upper substantially upright rear panel, forming a plurality of substantially J shaped channels for holding books and magazines therein, each of the plurality of substantially upright panels forming the rear portion of one of the substantially J shaped channels and the front portion of an adjacent one of the substantially J shaped channels, each of the plurality of substantially upright panels having one of the plurality of shelves substantially perpendicularly fastened thereto at a lower portion thereof and an adjacent one of the plurality of shelves substantially perpendicularly fastened thereto at an intermediate portion thereof, the upper substantially upright rear panel having an uppermost one of the plurality of shelves substantially perpendicularly fastened thereto at a lower portion thereof, the lower substantially upright front panel having a lowermost one of the plurality of shelves substantially perpendicularly fastened thereto at a lower portion thereof;

a pair of wooden substantially trapezoid shaped opposing side panels substantially perpendicularly removably fastened to the prefabricated wooden magazine and book rack one to the other, each of the wooden substantially trapezoid shaped opposing side panels having a top portion and a base portion substantially parallel one to the other, the base portion wider than the top portion, a substantially upright rear side portion substantially perpendicular to the base portion, and an angularly disposed front side portion;

a substantially upright rear panel, the pair of wooden substantially trapezoid shaped opposing side panels substantially perpendicularly removably fastened to the substantially upright rear panel one to the other;

a laterally directed substantially E shaped channel member receiving an uppermost portion of the upper substantially upright rear panel of the prefabricated wooden magazine and book rack and an uppermost portion of the substantially upright rear panel therein, the laterally directed substantially E shaped channel member having opposing ends removably fastened to the wooden substantially trapezoid shaped opposing side panels and holding the upper substantially upright rear panels of the pair of prefabricated wooden magazine and book racks in place.

4. A knockdown magazine and book rack kit, comprising:

a prefabricated wooden magazine and book rack, the prefabricated wooden magazine and book rack constructed of a plurality of substantially upright panels, a plurality of laterally directed shelves, a lower substantially upright front panel, and an upper substantially upright rear panel, forming a plurality of substantially J shaped channels for holding books and magazines therein, each of the plurality of substantially upright panels forming the rear portion of one of the substantially J shaped channels and the front portion of an adjacent one of the substantially J shaped channels, each of the plurality of substantially upright panels having one of the plurality of shelves substantially perpendicularly fastened thereto at a lower portion thereof and an adjacent one of the plurality of shelves substantially perpendicularly fastened thereto at an intermediate portion thereof, the upper substantially upright rear panel having an uppermost one of the plurality of shelves substantially perpendicularly fastened thereto at a lower portion thereof, the lower substantially upright front panel having a lowermost one of the plurality of shelves substantially perpendicularly fastened thereto at a lower portion thereof;

a pair of wooden substantially trapezoid shaped opposing side panels substantially perpendicularly removably fastened to the prefabricated wooden magazine and book rack one to the other, each of the wooden substantially trapezoid shaped opposing side panels having a top portion and a base portion substantially parallel one to the other, the base portion wider than the top portion, a substantially upright rear side portion substantially perpendicular to the base portion, and an angularly disposed front side portion;

a substantially upright intermediate panel, the pair of wooden substantially trapezoid shaped opposing side panels substantially perpendicularly removably fastened to the substantially upright intermediate panel one to the other;

a wooden top panel having a forwardly disposed laterally directed substantially C shaped channel receiving an uppermost portion of the upper substantially upright rear panel of the prefabricated wooden magazine and book rack and an uppermost portion of the substantially upright intermediate panel therein, the top panel having opposing ends removably fastened to the wooden substantially trapezoid shaped opposing side panels and holding the upper substantially upright rear panels of the pair of prefabricated wooden magazine and book racks in place;

at least one rear shelf having a forward edge adjacent the substantially upright intermediate panel, the pair of wooden substantially trapezoid shaped opposing side panels substantially perpendicularly removably fastened to the at least one rear shelf one to the other.

5. A knockdown magazine and book rack kit and packaging system combination, comprising:

a knockdown magazine and book rack kit and a substantially box shaped receiving package;

a substantially box shaped receiving package having at least one portion thereof adapted to be opened to receive the knockdown magazine and book rack kit therein and then closed;

the knockdown magazine and book rack kit, comprising:

a pair of prefabricated wooden magazine and book racks, each of the prefabricated wooden magazine and book racks constructed of a plurality of substantially upright panels, a plurality of laterally directed shelves, a lower substantially upright front panel, and an upper substantially upright rear panel, forming a plurality of substantially J shaped channels for holding books and magazines therein, each of the plurality of substantially upright panels forming the rear portion of one of the substantially J shaped channels and the front portion of an adjacent one of the substantially J shaped channels, each of the plurality of substantially upright panels having one of the plurality of shelves substantially perpendicularly fastened thereto at a lower portion thereof and an adjacent one of the plurality of shelves substantially perpendicularly fastened thereto at an intermediate portion thereof, the upper substantially upright rear panel having an uppermost one of the plurality of shelves substantially perpendicularly fastened thereto at a lower portion thereof, the lower substantially upright front panel having a lowermost one of the plurality of shelves substantially perpendicularly fastened thereto at a lower portion thereof;

a pair of wooden substantially symmetrical hexagonal shaped opposing side panels substantially perpendicularly for removably fastening to the pair of prefabricated wooden magazine and book racks one to the other, each of the wooden substantially symmetrical hexagonal shaped opposing side panels having a top portion and a base portion substantially parallel one to the other, the base portion wider than the top portion, substantially parallel lower opposing side portions substantially perpendicular to the base portion, and a pair of angularly disposed upper side portions;

a laterally directed substantially E shaped channel member for receiving uppermost portions of each of the upper substantially upright rear panels of the pair of prefabricated wooden magazine and book racks therein, the laterally directed substantially E shaped channel member having opposing ends for removably fastening to the wooden substantially symmetrical hexagonal shaped opposing side panels and holding the upper substantially upright rear panels of the pair of prefabricated wooden magazine and book racks in place;

each of the prefabricated wooden magazine and book racks constructed of a plurality of substantially upright panels, a plurality of laterally directed shelves, a lower substantially upright front panel, and an upper substantially upright rear panel, forming a plurality of substantially J shaped channels for holding books and magazines therein, each of the prefabricated wooden magazine and book racks inserted into the substantially box shaped receiving package facing and interleaved with one another for minimizing packaging size of the substantially box shaped receiving package, wherein:

adjacent ones of the plurality of substantially J shaped channels for holding books and magazines of the each of the prefabricated wooden magazine and book racks interleaved with one another.

6. A knockdown magazine and book rack kit and packaging system combination, comprising:

a knockdown magazine and book rack kit and a substantially box shaped receiving package;

a substantially box shaped receiving package having at least one portion thereof adapted to be opened to receive the knockdown magazine and book rack kit therein and then closed;

the knockdown magazine and book rack kit, comprising:

a pair of prefabricated wooden magazine and book racks, each of the prefabricated wooden magazine and book racks constructed of a plurality of substantially upright panels, a plurality of laterally directed shelves, a lower substantially upright front panel, and an upper substantially upright rear panel, forming a plurality of substantially J shaped channels for holding books and magazines therein, each of the plurality of substantially upright panels forming the rear portion of one of the substantially J shaped channels and the front portion of an adjacent one of the substantially J shaped channels, each of the plurality of substantially upright panels having one of the plurality of shelves substantially perpendicularly fastened thereto at a lower portion thereof and an adjacent one of the plurality of shelves substantially perpendicularly fastened thereto at an intermediate portion thereof, the upper substantially upright rear panel having an uppermost one of the plurality of shelves substantially perpendicularly fastened thereto at a lower portion thereof, the lower substantially upright front panel having a lowermost one of the plurality of shelves substantially perpendicularly fastened thereto at a lower portion thereof;

a pair of wooden substantially symmetrical hexagonal shaped opposing side panels substantially perpendicularly for removably fastening to the pair of prefabricated wooden magazine and book racks one to the other, each of the wooden substantially symmetrical hexagonal shaped opposing side panels having a top portion and a base portion substantially parallel one to the other, the base portion wider than the top portion, substantially parallel lower opposing side portions substantially perpendicular to the base portion, and a pair of angularly disposed upper side portions;

a laterally directed substantially C shaped channel member for receiving uppermost portions of each of the upper substantially upright rear panels of the pair of prefabricated wooden magazine and book racks therein, the laterally directed substantially C shaped channel member having opposing ends for removably fastening to the wooden substantially symmetrical hexagonal shaped opposing side panels and holding the upper substantially upright rear panels of the pair of prefabricated wooden magazine and book racks in place;

each of the prefabricated wooden magazine and book racks constructed of a plurality of substantially upright panels, a plurality of laterally directed shelves, a lower substantially upright front panel, and an upper substantially upright rear panel, forming a plurality of substantially J shaped channels for holding books and magazines therein, each of the prefabricated wooden magazine and book racks inserted into the substantially box shaped receiving package facing and interleaved with one another for minimizing packaging size of the substantially box shaped receiving package, wherein:

adjacent ones of the plurality of substantially J shaped channels for holding books and magazines of the each of the prefabricated wooden magazine and book racks interleaved with one another.

* * * * *